US006042616A

United States Patent [19]

Yanai et al.

[11] Patent Number: 6,042,616

[45] Date of Patent: Mar. 28, 2000

[54] METHOD FOR PROCESSING CELLULOSE FIBER-CONTAINING TEXTILE FABRICS

[75] Inventors: Yuichi Yanai; Masayoshi Oba; Kazuhiko Ichimura; Yasushi Takagi; Kazuhiko Harada, all of Okazaki, Japan

[73] Assignee: Nisshinbo Industries, Inc., Tokyo, Japan

[21] Appl. No.: 09/148,860

[22] Filed: Sep. 8, 1998

[30] Foreign Application Priority Data

Sep. 8, 1997 [JP] Japan ..... 9-259288

[51] Int. Cl.[7] ..... D06M 13/322

[52] U.S. Cl. ..... 8/115.51; 8/495; 8/497; 8/530; 8/531; 8/532; 8/533; 8/534; 8/594; 8/619; 8/116.1; 8/181; 8/125; 8/127.6; 8/129; 427/389.9; 427/392

[58] Field of Search ..... 8/495, 497, 529–534, 8/594, 619, 115.51, 116.1, 181, 125, 127.6, 129; 427/389.9, 392

[56] References Cited

U.S. PATENT DOCUMENTS

| | | | |
|---|---|---|---|
| 3,656,885 | 4/1972 | Gagliardi | 8/127.6 |
| 4,286,958 | 9/1981 | Fujiu et al. | 8/471 |
| 4,295,847 | 10/1981 | Petersen et al. | 8/125 |
| 4,475,917 | 10/1984 | Ohshima et al. | 8/125 |
| 5,879,410 | 3/1999 | Yanai et al. | 8/181 |
| 5,910,279 | 6/1999 | Yanai et al. | 264/282 |

OTHER PUBLICATIONS

Bishop et al. Chemistry of the Textiles Industry pp. 177–178, 1995.

*Primary Examiner*—Yogendra Gupta
*Assistant Examiner*—Brian P. Mruk
*Attorney, Agent, or Firm*—Birch, Stewart, Kolasch & Birch, LLP

[57] ABSTRACT

A method for finishing a cellulose fiber-containing textile fabric comprises treating a cellulose fiber-containing textile fabric with liquid ammonia, applying a resin finishing agent to said fabric, subjecting subsequently to either or both of a hot calendering treatment and a heat treatment, and finally treating the resultant fabric with hot water. The resultant fabric keeps its shape stability including a crease or shrink resistance when washed, without involving any problem on residual formaldehyde.

17 Claims, No Drawings

METHOD FOR PROCESSING CELLULOSE FIBER-CONTAINING TEXTILE FABRICS

BACKGROUND OF THE INVENTION

1. Field of the Invention

This invention relates to a method for finishing cellulose fiber-containing textile fabrics, and more particularly, to an improved method for finishing cellulose fiber-containing textile fabrics wherein the textile fabrics are improved in shape stabilities including, for example, shrink and crease resistances and an amount of residual formaldehyde is reduced when formaldehyde resin finishing agents are used.

2. Description of the Prior Art

In order to impart good shape stabilities, such as shrink and crease resistances, to cellulose fiber textile fabrics, various studies have been hitherto made on resin finishing agents and resin finishing methods.

The reason why textiles suffer creases or shrinkage is that hydrogen bonds in non-crystalline regions of cellulose are broken and deformed by an external force or by the action of moisture, under which hydrogen bonds are once again formed.

The impartment of a crease or shrink resistance by the resin finishing of textiles makes use of the principle that cellulose molecules are crosslinked through a resin finishing agent, and hydrogen bonds are unlikely to be broken by an external force or by the action of moisture owing to the introduction of the crosslinkage. In this case, it is usual to use so-called cellulose reactive type resins, such as glyoxal resins, as the resin finishing agent.

However, conventional resin finishing methods have problems which run counter to each other: More particularly, where an amount of a resin to be applied to is increased for the purpose of enhancing the crease or shrink resistance, an amount of residual formaldehyde inevitably increases. On the other hand, when the amount of a resin is decreased, the crease or shrink resistance lowers. In practice, the resin finishing has now been carried out while well balancing the crease or shrink resistance and the increase in amount of residual formaldehyde, which are contrary in nature to each other.

In order to prevent plumelets from escaping, for example, from feather quilts, there is used a method wherein a cotton woven fabric for feather quilt is subjected to high-pressure calendering to reduce air permeability thereof. However, cotton fabrics are very liable to crease and undergoes shrinkage by washing. In this connection, however, if cotton fabrics are treated with liquid ammonia, creases decrease in number with an improved shrink resistance. When such fabrics are washed, air permeability increases with the possibility of permitting plumelets to escape. On the other hand, when resins are used in combination, the permeability can be kept low to an extent after washing, but still unsatisfactory. In addition, such a fabric feels hard to the touch, coupled with another problem on the residual formaldehyde derived from resins, which have been ordinarily employed as described above. This, in turn, presents the problem that a difficulty is involved in carrying out the resin finishing in the field, such as of feather quilt, where residual formaldehyde is severely regulated.

SUMMARY OF THE INVENTION

It is an object of the invention to provide a method for finishing cellulose fiber-containing textile fabrics which overcome the problems of the prior art.

It is another object of the invention to provide a method for finishing cellulose fiber-containing textile fabrics which can impart good shape stabilities, such as a shrink or crease resistance, to textile fabrics without a sacrifice of practical strength and which is subtstantially free of any problem of residual formaldehyde.

It is a further object of the invention to provide a method for finishing cellulose fiber-containing textile fabrics whereby the resultant fabrics are good to the touch and undergo only a reduced change in characteristics after washing.

In order to achieve the above objects, we have made intensive studies and, as a result, found that when cellulose fiber-containing textile fabrics are treated with liquid ammonia and then applied with a resin finishing agent, subjected to either or both of a hot calendering treatment and a heat treatment, and finally treated with hot water, the fabrics are improved in the shape stabilities. It has also been found that on comparison with the case where resin finishing is merely performed, the shape stabilities are significantly improved thereover, and initial shape stabilities are maintained after repetition of washings. In addition, when using resins as a resin finishing agent, there arises no problem of residual formaldehyde, along with the resultant finished fabric being good to the touch. The invention has been accomplished based on the above findings.

Hence, the present invention contemplates to provide a method for finishing a cellulose fiber-containing textile fabric which comprises treating with liquid ammonia, applying a resin finishing agent to the thus treated fabric, subjecting the applied fabric with either or both of a hot calendering treatment and a heat treatment, and finally subjecting the fabric to hot water treatment. It is preferred that after the application of the resin finishing agent, the fabric is subjected to the hot calendering treatment and then to the heat treatment.

The reason why the shape stabilities, such as a shrink or crease resistance, are improved, and residual formaldehyde is much reduced in amount is considered as follows. When treated with liquid ammonia, the fibers are swollen, simultaneously with their crystalline structure being converted from cellulose I or II to cellulose III. In the practice of the invention, while keeping the fiber in the swollen state, the resin finishing is performed, followed by treatment with hot water. When treated with hot water, the crystalline structure can be returned from cellulose III to the cellulose I or II, which consists of a more stable crystalline structure, while keeping the shape established according to the resin finishing. Thus, the resultant structure becomes more stable than that attained by treating the fibers merely with liquid ammonia, and residual formaldehyde is substantially free.

DETAILED DESCRIPTION OF THE INVENTION

The invention is described in more detail.

The method of the invention for finishing cellulose fiber-containing textile fabrics comprises treating a cellulose fiber-containing textile fabric according to the following sequence of steps:

(1) the step of treating with liquid ammonia;

(2) the step of applying a resin finishing agent;

(3) the hot calendering step;

(4) the heat treating step; and (5) the step of treating with hot water.

In this connection, either of the hot calendering step (3) or the heat treating step (4) may be omitted, if required.

The fibers used as the cellulose fiber-containing textile fabrics include natural fibers and regenerated cellulose fibers such as cotton, flax, rayon, polynosic, cuprammonium rayon, regenerated cellulose (e.g. commercially available under the designation of "Tencel"), and the like fibers, and composite fibers of these natural or regenerated cellulose fibers blended with synthetic fibers such as polyester, acrylic and nylon fibers. In the latter case, the ratio of the cellulose fibers in the composite fibers should generally be in the range of 20 wt % or over, preferably 40 wt % or over. If necessary, these cellulose fiber-containing textile fabrics may be subjected to any known pretreatments such as singeing, desizing, scouring, bleaching, mercerizing and the like. The textile fabrics may be dyed or printed.

The step (1) of the invention consists of the step of treating with liquid ammonia wherein the fabric is dipped in liquid ammonia maintained at temperatures of −33° C. or below at normal pressures. The dipping methods include any of a method wherein textile fabrics are immersed in a liquid ammonia bath, a method wherein liquid ammonia is sprayed over or coated onto textile fabrics, and the like. The dipping time may be appropriately selected, and is generally in the range of 5 to 40 seconds. After the treatment with liquid ammonia, ammonia attached to the textile fabric is removed by heating to evaporate the ammonia.

After the treatment with liquid ammonia, a resin finishing agent is applied to as set out under (2) above.

In this case, resin finishing agents may be ones which are able to react with hydroxyl groups of cellulose to form crosslinkage. Examples of such compounds include aldehydes such as formaldehyde, glyoxal, glutaraldehyde and the like, epoxy compounds such as diglycidyl ether, polycarboxylic acids such as tetrabutanecarboxylic acid, and cellulose reactive type N-methylol compounds such as dimethylolurea, trimethylolmelamine, dimethylolethyleneurea, dimethyloldihydroxyethyleneurea, and the like. Of these, the N-methylol compounds are preferred from the standpoint that the improvement in the crease or shrink resistance and the lowering in strength of the fabric are well balanced after resin finishing therewith.

The amount of the resin finishing agent is preferably in the range of 0.5 to 10 wt % and more preferably from 1 to 8 wt %, calculated as solids, relative to the weight of a cellulose fiber-containing textile fabric to be finished with the agent. If the amount is less than 0.5 wt %, the resin finishing effect may not be shown satisfactorily. On the other hand, when the amount exceeds 8 wt %, the strength may lower considerably owing to the resin finishing.

The resin finishing agent used in the present invention may further comprise catalysts which serve to enhance the reactivity between the resin finishing agent and cellulose so as to permit the resin finishing to proceed quickly. Such catalysts are not critical so far as they are ordinarily used for the resin finishing purpose. Examples of the catalyst include borofluorides such as ammonium borofluoride, sodium borofluoride, potassium borofluoride, zinc borofluoride and the like, neutral metal salts such as magnesium chloride, magnesium sulfate, magnesium nitrate and the like, and inorganic acids such as phosphoric acid, hydrochloric acid, sulfuric acid, sulfurous acid, hyposulfurous acid, boric acid and the like. If necessary, these catalysts may be used in combination with organic acid cocatalysts such as citric acid, tartaric acid, malic acid, maleic acid and the like.

Moreover, the resin finishing agent may further comprise auxiliaries for permitting smooth reaction between cellulose and a resin to proceed, if necessary. More particularly, the auxiliaries serve to promote the reaction between the resin finishing agent and cellulose, act as a reaction solvent with which reaction proceeds uniformly for the formation of crosslinkage, and also act to cause cellulose to be swollen.

Examples of the auxiliaries include polyhydric alcohols such as glycerine, ethylene glycol, polyethylene glycol, polypropylene glycol and the like, ether alcohols such as ethylene glycol monoethyl ether, diethylene glycol monoethyl ether, ethylene glycol monomethyl ether, diethylene glycol monomethyl ether, diethylene glycol monobutyl ether and the like, nitrogen-containing solvents such as dimethylformamide, morpholine, 2-pyrrolidone, dimethylacetamide, N-methylpyrrolidone and the like, and esters such as ethyl acetate, isopropyl acetate, butyl acetate, amyl acetate, ethylene glycol monomethyl ether acetate, ethylene glycol monoethyl ether acetate, γ-butyrolactone and the like.

Where it is intended to lower air permeability such as of feather quilts, down jackets and the like for the shape stability, a filing agent may be added to the liquid resin finish. Examples of the filling agent include any known ones such as silicone acrylic resins, silicone polyurethane resins, acrylic resins, polyurethane resins, reactive silicones and the like. The amount of the agent should preferably be in the range of 0.5 to 3 wt %, preferably 1 to 2 wt %, calculated as solid matters, relative to the weight of the cellulose fiber-containing textile fabric, within which it is properly selected depending on the desired degree of air permeability of a textile fabric.

The resin finishing agent of the invention may further comprise, aside from the above chemicals, softening agents or softeners for controlling a feel to the touch and formaldehyde catchers for reducing a concentration of free formaldehyde, if necessary.

In the practice of the invention, the resin finishing agent is applied to a cellulose fiber-containing textile. The manner of the application is not critical, and any known methods, such as an ordinary pad dry method, a vapor phase reaction (VP reaction) method and the like, may be used.

The pad dry method comprises immersing a textile fabric in a liquid composition containing a resin finishing agent, squeezing to a squeeze rate of 40 to 120%, and drying in an atmospheric temperature of about 70 to 100° C. If the atmospheric temperature is lower than 70° C., a long drying time becomes necessary. On the other hand, when the temperature exceeds 100° C., the resin finishing agent may migrate, with the attendant disadvantage that the finishing agent is not distributed uniformly.

After the application of the resin finishing agent, the fabric may be subjected to hot calendering. Especially, with feather quilts or the like whose air permeability is required to lower, not only a more effective filling effect is expected, but also the resin reaction is more facilitated according to this treatment.

The hot calendering treatment may be carried out in a usual manner generally under conditions of a temperature of 120 to 200° C., a nip pressure of 200 to 300 kg/cm, and a speed of 5 to 15 m/minute, within which these conditions are appropriately selected depending on a desired air permeability of textile fabrics.

Subsequently, a heat treatment is effected to complete the resin reaction. It will be noted that if the hot calendering is carried out in a manner as stated above by -which the resin reaction can be satisfactorily completed, the heat treatment may be omitted. The heat treatment is effected such that the textile fabric is heat-treated under conditions of a temperature of 120 to 170° C., preferably 130 to 160° C., and a time of 1 to 15 minutes, preferably 2 to 10 minutes, thereby causing crosslinkage to be formed. The temperature and time of the heat treatment depend on the type and amount of resin and the type and amount of catalyst. However, if the heat treating temperature is lower than 120° C., the reaction proceeds only slowly. The temperature over 170° C. may be disadvantageous in that the fabric undergoes yellowing.

In the practice of the invention, a hot water treatment is finally carried out, and this treatment can remarkably improve the shape stabilities, typical of which are crease and shrink resistances, of the textile fabric obtained through the above-stated treatments (2), and (3) and/or (4). If the resultant fabric is washed, the shape stabilities are effectively kept, without involving any problem on residual formaldehyde as would be otherwise caused by the resin finishing, with the fabric being good to the touch. In this connection, where it is required to lower air permeability as with feather quilts, this characteristic property is ensured.

The hot water treatment is carried out by treating a cellulose fiber-containing textile fabric with hot water or steam at a temperature of 98° C. or higher. For this purpose, an apparatus which is capable of hot water treatment at high pressure may be used, including, for example, a high pressure jet dyeing machine, a high pressure paddle dyeing machine, a high pressure drum dyeing machine, a high pressure jigger dyeing machine, a high pressure beam dyeing machine, a high pressure steamer or the like. Depending on the kind of texture, the hot water treatment may be effected in a tension-free condition by use of a high pressure jet dyeing machine, a high pressure paddle dyeing machine, a high pressure drum dyeing machine or the like. Alternatively, a high pressure jigger dyeing machine, a high pressure beam dyeing machine, a high pressure steamer or the like may be used under a slight tension. In this way, the hot water treatment can be performed while keeping a smooth texture.

Where the hot water treatment is effected in a tension-free condition using a high pressure jet dyeing machine, a high pressure paddle dyeing machine, a high pressure drum dyeing machine or the like, the stress in the textile structure is relaxed, with the attendant merit that the shrink resistance is improved along with a wet crease resistance being improved due to the setting effect resulting from the hot water treatment. This leads to the advantage of imparting cripness ("Hari") and resilience ("Koshi") to the fabric, thereby providing some change in surface properties.

On the other hand, where the hot water treatment is effected in a slightly tensioned condition by use of a high pressure beam dyeing machine, a high pressure jigger dyeing machine or a high pressure steamer, the flatness of the textile is maintained during the course of the treatment with hot water, with the advantage that the textile is substantially free of any wrinkles and irregularities without curling at the salvages thereof. Moreover, a great amount of textiles can be finished at the same time.

It will be noted that the hot water treating time can be appropriately selected. The preferred hot water treatment condition is as follows:

(a) in case of a treating temperature of 98° C. to less than 105° C., the treating time is 2 hours or more, preferably 2.5 hours or more, (b) in case of a treating temperature of 105° C. to less than 115° C., the treating time is 1 hour or more, preferably 1.5 hours or more, (c) in case of a treating temperature of 115° C. to less than 125° C., the treating time is 40 minutes or more, preferably 1 hour or, more.

(d) in case of a treating temperature of 125° C. to less than 135° C., the treating time is 30 minutes or more, preferably 1 hour or more, and (e) in case of a treating temperature of 135° C. to 150° C., the treating time is 20 minutes or more, preferably 1 hour or more.

The upper limit of the treating time is preferably 5 hours.

For the hot water treatment, a softener may be added to the hot water so that the textile fabric is imparted with softness. The softener may be one whose composition is not changed when treated at high temperatures over a long period and which is able to impart softness to the fabric. Examples of such a softener include known compounds such as fatty acid-amide condensation compounds, fatty acid ester compounds and the like. The amount in hot water ranges from 0.1 to 10 wt %, preferably from 0.3 to 3 wt %.

The method of the invention is favorably applicable to textile fabrics wherein their shape stability is essentially required. In this case, air permeability of a finally finished textile fabric is selected as desired. Especially, with the case of textiles used for feather quilts and down jackets, air permeability should preferably be in the range of 1 cc to less than 3 cc. If the air permeability is too low, comfort may lower at the time of perspiration.

According to the method of the invention, there can be thus obtained cellulose fiber-containing textile fabrics whose shape stability including a crease or shrink resistance is kept after washing and which is substantially free of any problem of residual formaldehyde.

The invention is more particularly described by way of examples, which should not be construed to limiting the invention. Comparative examples are also shown.

EXAMPLE 1

A cotton 100% woven fabric of 160-count two-folded yarn satin weave (warp density 231 yarns/inch, weft density 200 yarns/inch) was subjected to singeing, de-sizing, scouring, and bleaching, followed by treatment with liquid ammonia at −34° C. for 20 seconds and removal of attached ammonia by heating to evaporate the ammonia.

Thereafter, a liquid resin finish indicated in Table 1 was impregnated in the fabric, and an excess liquid was squeezed by means of mangles so that the amount was so controlled as shown in Table 1. After drying, hot calendering was effected under conditions of 160° C.×200 kg/cm×5 m/minute, followed by heat treatment under conditions of 160° C.×2 minutes. Subsequently, a hot water treatment (130° C.×2 hours) was performed as the fabric was kept in a state of being wound around a beam, followed by drying.

Comparative Example 1

A fabric of the same type as used in the example 1 was subjected to singeing, de-sizing, scouring, bleaching, treatment with liquid ammonia and removal of attached ammonia, followed by dipping with a finishing agent indicated in Table 1 under the same condition as in Example 1. After drying, the hot calendering treatment was performed also under the same conditions as in Example 1.

The fabric (for feather quilt) obtained according to the above procedures were each subjected to evaluation of characteristic properties, with the results shown in Table 2.

TABLE 1

| | | Liquid Resin Finish (Example 1) | Finish (Comparative Example 1) |
|---|---|---|---|
| Modified glyoxal resin 1) (content of effective component: 50%) | | 7.0 g | — |
| Metal salt catalyst 2) | | 2.0 g | — |
| Silicone acrylic emulsion 3) (content of effective component: 30%) | | 10.0 g | 10.0 g |
| Polyethylene emulsion 4) | | 2.0 g | 2.0 g |
| Nonionic surface active agent 5) | | 0.5 g | 0.5 g |
| Total amount (a balance being water) | | 100 ml | 100 ml |
| Pick-up of liquid finish (%) | | 50 | 50 |
| Pick-up of effective component(s) (%) | modified glyoxal resin | 1.75 | — |
| | silicone acrylic emulsion | 1.50 | 1.50 |

Note:
1) Riken Resin LNB-20 (Miki Riken Ind. Co., Ltd.)
2) Catalyst M (Dainippon Ink and Chemicals, Incorporated)
3) Charine EFE23O (Nisshin Chem. Co., Ltd.)
4) Sofvon P3000 (Takemoto Oils and Fats Co., Ltd.)
5) Fine Tex NRW (Dainippon Ink and Chemicals, Incorporated)

TABLE 2

| | | | Example 1 | Comparative Example 1 |
|---|---|---|---|---|
| Air permeability (cc) 6) | immediately after finishing | | 1.2 | 0.6 |
| | after five washings | | 1.5 | 5.9 |
| Formalin (ppm) 7) | immediately after finishing | | not detected | not detected |
| | after five washings | | not detected | not detected |
| Stiffness and softness (mg) 8) | immediately after finishing | | 4.6 | 5.0 |
| | after five washings | | 3.6 | 4.6 |
| Tear strength (g) 9) | immediately after finishing | | 920 | 1370 |
| | after five washings | | 950 | 1280 |
| Tensile strength (kg) 10) | immediately after finishing | | 54.8 | 74.2 |
| | after five washings | | 54.8 | 60.0 |
| Crease resistance (°) 11) | immediately after finishing | dry | 258 | 204 |
| | | wet | 275 | 184 |
| | after five washings | dry | 241 | 225 |
| | | wet | 237 | 193 |
| Shrinkage by washing (%) | after one washings | warp | 0.8 | 3.2 |
| | | weft | −0.1 | 0.8 |
| Tumbling by 103 method | after five washings | warp | 1.2 | 3.8 |
| | | weft | −0.1 | 1.2 |

Note:
6) Determined by method A described in JIS L1096.
7) Determined by the acetylacetone method in method B described in JIS L1041.
8) Determined by the Gurley method in method A described in JIS L1096.
9) Determined by the Penjuram method in method D described in JIS L1096.
10) Determined by the ravel strip method in method A described in JIS L1096.
11) Determined by the method described in JIS L1059.

The above results reveal that when using the method of Example 1, the air permeability scarcely increases after washing and is kept substantially at an initial level of air permeability and that irrespective of the high crease resistance, little residual formaldehyde is present. In addition, after washing, little variation is found in the physical properties, crease resistance and shrinkage.

EXAMPLE 2

A cotton 100% knitted fabric of 40-count two-folded yarn single tuck (KANOKO) (30 inches and 18 gages) was subjected to alkaline treatment, and bleached by a usual manner, treated with liquid ammonia at −34° C. for 20 seconds and heated to evaporate the ammonia, followed by resin finishing according to the resin formation and the heat treating conditions indicated in Table 3. Thereafter, a hot water treatment using a high pressure jet dyeing machine was effected at 130° C. for 1 hour, followed by dehydration, drying and finishing with a softener by means of a tenter to obtain a fabric with a given width.

EXAMPLE 3

The general procedure of Example 2 was repeated except that when treated with the hot water, 5.0 g/liter of a softener (Aviva SFC: fatty acid-amide condensate, made by Chiba Geigy Ltd.) was added to the hot water.

Comparative Example 2

The resin finishing was carried out using the resin formulation and heat treating conditions indicated in Table 3. In the resin formulation, the concentration of formaldehyde was suppressed at a low level, so that the amount of the resin was reduced.

The fabric obtained according to the above procedures were each subjected to evaluation of characteristic properties, with the results shown in Table 3.

TABLE 3

| | | Example 2 | Example 3 | Comparative Example 2 |
|---|---|---|---|---|
| Resin formulation (g/liter) | LNB-20 12) | 150 | 150 | 60 |
| | Cat. M 13) | 60 | 60 | 25 |
| | HP-780 14) | — | — | 15 |
| | SN-15 15) | — | — | 40 |
| | NSW-2 16) | — | — | 15 |
| | FW 17) | 15 | 15 | 15 |
| | PEG-200 18) | — | — | 20 |
| Heat treating conditions | temperature (° C.) | 160 | 160 | 160 |
| | time (minutes) | 1.5 | 1.5 | 1.5 |
| Softener in bath (g/liter) | AVIVAN SFC 19) | — | 5.0 | — |
| Softener formulation (g/liter) | HP-780 14) | 15 | 15 | — |
| | SN-15 15) | 40 | 40 | — |
| | MSW-2 16) | 15 | 15 | — |
| Dry shrinkage by tumbling (%) warp/weft (total) | | 4.5/3.2 (7.7) | 5.0/3.0 (7.7) | 7.3/4.2 (11.5) |
| Bursting strength (kg/cm2) | | 6.3 | 8.0 | 7.5 |
| Formalin (ppm) | | 12 | 19 | 54 |
| Moisture content (%) | | 28.4 | 28.3 | 32.9 |
| Drape | | 0.31 | 0.26 | 0.28 |

Note:
12) Riken resin LNB-20: Reactive-with-fiber type N-methylol resin (Miki Riken Ind. Co., Ltd.)
13) Cat. M: magnesium chloride catalyst (made by Dainippon Ink and Chemicals Incorporated)
14) Meika Tex HP-780: sewable improver (Meisei Chem. Ind. Co. Ltd.)
15) Sofmin SN-15: fatty acid ester softener (Miyoshi Fat & Oil Co., Ltd.)
16) MSW-2: silicone softener (Matsumoto Fat & Oil Pharm. Co., Ltd.)
17) Sumitex Buffer FW: formalin catcher (Sumitomo Chemical Co., Ltd.)
18) PEG-200: polyethylene glycol (Sanyo Chemical Industries, Ltd.)
19) Avivan SFC: fatty acid-amide condensate (Chiba Geigy AG)

As will become apparent from the above results, Examples 2,3 are superior to Comparative Example 2 with respect to the shrink resistance, and are smaller in the residual formaldehyde, with the practical strength being maintained at a level. Example 3 wherein the softener is added to the bath at the time of the thermal treatment permits the resultant fabric to becomes soft to the touch without impeding the properties such as a shrink resistance.

What is claimed is:

1. A method for finishing a cellulose fiber-containing textile fabric comprising treating a cellulose fiber-containing textile fabric with liquid ammonia, applying a resin finishing agent to said fabric, subsequently subjecting to either or both of a hot calendering treatment and a heat treatment, and finally treating the resultant fabric with hot water, said hot water treatment being carried out by treating the cellulose fiber-containing textile fabric with hot water or steam at a temperature of 98° C. or higher to improve the shape stability of said fabric, and wherein said hot water treatment converts the crystalline structure of the fibers of the fabric from cellulose III to cellulose I or II.

2. A method according to claim 1, wherein a softener is added to the hot water in the course of the hot water treatment.

3. A method according to claim 1 or 2, wherein after the application of said resin finishing agent, said fabric is subjected to the hot calendering treatment and then to the heat treatment.

4. The method according to claim 1, wherein the hot water or steam treatment is carried out in the following condition:

(a) in case of a treating temperature of 98° C. to less than 105° C., the treating time is 2 hours or more, (b) in case of a treating temperature of 105° C. to less than 115° C., the treating time is 1 hour or more, (c) in case of a treating temperature of 115° C. to less than 125° C., the treating time is 40 minutes or more, (d) in case of a treating temperature of 125° C. to less than 135° C., the treating time is 30 minutes or more, and (e) in case of a treating temperature of 135° C. to 150° C., the treating time is 20 minutes or more.

5. The method according to claim 1, wherein the hot water or steam treatment comprises: heating to a treating temperature of between 98° C. and less than 105° C., and maintaining said treating temperature for at least two hours.

6. The method according to claim 1, wherein the hot water or steam treatment comprises: heating to a treating temperature of between 105° C. and less than 115° C., and maintaining said treating temperature for at least one hour.

7. The method according to claim 1, wherein the hot water or steam treatment comprises: heating to a treating temperature of between 115° C. and less than 125° C., and maintaining said treating temperature for at least forty (40) minutes.

8. The method according to claim 1, wherein the hot water or steam treatment comprises: heating to a treating temperature of between 125° C. and less than 135° C., and maintaining said treating temperature for at least thirty minutes.

9. The method according to claim 1, wherein the hot water or steam treatment comprises: heating to a treating temperature of between 135° C. and 150° C., and maintaining said treating temperature for at least twenty minutes.

10. A method according to claim 1, wherein said cellulose fiber-containing textile fabric comprises a composite fiber containing at least 20 weight percent of cellulose fiber in the composite fiber.

11. A method according to claim 1, wherein said cellulose fiber-containing textile fabric comprises a composite fiber containing at least 40 weight percent of cellulose fiber in the composite fiber.

12. A method according to claim 1, wherein said hot water or steam treatment is performed under slight tension.

13. A method according to claim 1, wherein said hot water or steam treatment is performed under tension-free conditions.

14. A method according to claim 2, wherein said softener is added in an amount between 0.1 and 10.0 weight percent in hot water.

15. A method according to claim 2, wherein said softener is added in an amount between 0.3 and 3.0 weight percent in hot water.

16. A method according to claim 1, wherein a filling agent is added to said resin finishing agent in the amount between 0.5 and 3.0 weight percent, calculated as solid matters, relative to the weight of the cellulose fiber-containing textile fabric.

17. A method according to claim 1, wherein a filling agent is added to said resin finishing agent in the amount between 1.0 and 2.0 weight percent, calculated as solid matters, relative to the weight of the cellulose fiber-containing textile fabric.

* * * * *